US007767059B2

(12) United States Patent
Ryan et al.

(10) Patent No.: US 7,767,059 B2
(45) Date of Patent: Aug. 3, 2010

(54) STRONG AND DISPERSIBLE PAPER PRODUCTS

(75) Inventors: Michael Ryan, Newtown, CT (US); David L. Dauplaise, Stamford, CT (US)

(73) Assignee: Kemira Oyj (FI)

( * ) Notice: Subject to any disclaimer, the term of this patent is extended or adjusted under 35 U.S.C. 154(b) by 767 days.

(21) Appl. No.: 10/517,084

(22) PCT Filed: Jun. 18, 2003

(86) PCT No.: PCT/US03/19348

§ 371 (c)(1), (2), (4) Date: Apr. 6, 2005

(87) PCT Pub. No.: WO04/001127

PCT Pub. Date: Dec. 31, 2003

(65) Prior Publication Data

US 2005/0178515 A1 Aug. 18, 2005

Related U.S. Application Data

(60) Provisional application No. 60/389,778, filed on Jun. 19, 2002.

(51) Int. Cl.
*D21H 17/27* (2006.01)
*D21H 17/33* (2006.01)
*D21H 17/45* (2006.01)
*D21H 21/20* (2006.01)

(52) U.S. Cl. ..... 162/164.3; 162/158; 162/164.1; 162/154.6; 162/168.3; 162/168.5

(58) Field of Classification Search ..... 162/158, 162/164.1, 164.3, 164.6, 168.3, 168.5
See application file for complete search history.

(56) References Cited

U.S. PATENT DOCUMENTS

| | | | | | |
|---|---|---|---|---|---|
| 3,556,932 | A | | 1/1971 | Coscia et al. | 162/166 |
| 3,616,797 | A | * | 11/1971 | Champaigne et al | 604/364 |
| 3,702,610 | A | | 11/1972 | Sheppard et al. | 128/284 |
| 3,707,430 | A | * | 12/1972 | Costanza et al | 428/169 |
| 3,798,120 | A | | 3/1974 | Enloe et al. | 162/112 |
| 3,865,775 | A | * | 2/1975 | Drelich et al. | 524/407 |
| 3,913,579 | A | * | 10/1975 | Srinivasan et al. | 604/366 |
| 4,208,459 | A | | 6/1980 | Becker et al. | 428/154 |
| 4,603,176 | A | | 7/1986 | Bjorkquist et al. | 525/329.4 |
| 5,143,776 | A | | 9/1992 | Givens | 428/194 |
| 5,246,545 | A | | 9/1993 | Ampulski et al. | 162/112 |
| 5,466,318 | A | | 11/1995 | Björk | 156/183 |
| 5,490,902 | A | | 2/1996 | Schulz | 162/109 |
| 5,667,635 | A | | 9/1997 | Win et al. | 162/109 |
| 5,762,644 | A | | 6/1998 | Osborn, III et al. | 604/385.1 |
| 5,824,190 | A | | 10/1998 | Guerro et al. | 162/135 |
| 5,840,403 | A | | 11/1998 | Trokhan et al. | 428/154 |
| 5,851,352 | A | | 12/1998 | Vinson et al. | 162/112 |
| 5,885,265 | A | | 3/1999 | Osborn, III et al. | 604/367 |
| 5,891,126 | A | | 4/1999 | Osborn, III et al. | 604/385.1 |
| 5,916,205 | A | | 6/1999 | Olson et al. | 604/385.1 |
| 5,935,383 | A | | 8/1999 | Sun et al. | 162/158 |
| 5,948,710 | A | | 9/1999 | Pomplun et al. | 442/341 |
| 5,952,251 | A | | 9/1999 | Jackson et al. | 442/340 |
| 5,964,689 | A | | 10/1999 | McFall et al. | 493/395 |
| 5,968,026 | A | | 10/1999 | Osborn, III et al. | 604/378 |
| 6,017,418 | A | * | 1/2000 | Oriaran et al. | 162/111 |
| 6,022,449 | A | | 2/2000 | Jansen et al. | 162/135 |
| 6,033,391 | A | | 3/2000 | Osborn, III et al. | 604/385.1 |
| 6,034,181 | A | | 3/2000 | Bazaj et al. | 525/218 |
| 6,045,544 | A | | 4/2000 | Hershberger et al. | 604/385.1 |
| 6,096,152 | A | | 8/2000 | Anderson et al. | 156/183 |
| 6,113,723 | A | | 9/2000 | McNeil et al. | 156/209 |
| 6,117,525 | A | | 9/2000 | Trokhan et al. | 428/154 |
| 6,149,769 | A | | 11/2000 | Mohammadi et al. | 162/111 |
| 6,162,327 | A | * | 12/2000 | Batra et al. | 162/109 |
| 6,171,292 | B1 | | 1/2001 | Osborn, III et al. | 604/385.17 |
| 6,261,277 | B1 | | 7/2001 | Osborn, III et al. | 604/385.17 |
| 6,261,679 | B1 | * | 7/2001 | Chen et al. | 428/317.9 |
| 6,281,291 | B1 | | 8/2001 | Bazaj et al. | 525/218 |
| 6,322,665 | B1 | | 11/2001 | Sun et al. | 162/158 |
| 6,379,499 | B1 | | 4/2002 | Yang et al. | 162/168.1 |
| 6,409,713 | B1 | | 6/2002 | Osborn, III et al. | 604/385.17 |
| 6,436,234 | B1 | * | 8/2002 | Chen et al. | 162/109 |
| 6,494,990 | B2 | | 12/2002 | Bazaj et al. | 162/168.3 |
| 6,610,173 | B1 | * | 8/2003 | Lindsay et al. | 162/109 |
| 6,702,923 | B1 | | 3/2004 | Gorzynski et al. | 162/164.6 |
| 6,824,650 | B2 | * | 11/2004 | Lindsay et al. | 162/168.2 |
| 6,852,197 | B2 | | 2/2005 | Wallenius et al. | 162/164.6 |
| 2001/0051687 | A1 | | 12/2001 | Bazaj et al. | 525/218 |

(Continued)

FOREIGN PATENT DOCUMENTS

| | | |
|---|---|---|
| EP | 802282 | 10/1997 |

(Continued)

*Primary Examiner*—Steven P Griffin
*Assistant Examiner*—Dennis Cordray
(74) *Attorney, Agent, or Firm*—Cantor Colburn LLP

(57) ABSTRACT

The invention relates to a flushable paper product comprising a fibrous substrate having (i) at least one strength region comprising a reacted cationic or a reacted nonionic strength agent and (ii) at least one dispersibility region, wherein the paper product has (a) a dispersibility of at least one tenth of a second, (b) a dry strength, and (c) a wet strength of at least about five percent of the dry strength.

14 Claims, No Drawings

U.S. PATENT DOCUMENTS

| | | | | |
|---|---|---|---|---|
| 2002/0096281 | A1 | 7/2002 | Wallenius et al. | 162/164.1 |
| 2002/0099350 | A1 | 7/2002 | Osborn, III et al. | 604/385.17 |
| 2002/0104633 | A1 | 8/2002 | Sun et al. | 162/168.1 |
| 2003/0024667 | A1 | 2/2003 | Wallenius et al. | 162/109 |
| 2004/0140073 | A1 | 7/2004 | Gorzynski et al. | 162/168.2 |
| 2004/0149411 | A1 | 8/2004 | Krüger et al. | 162/164.1 |

FOREIGN PATENT DOCUMENTS

| | | |
|---|---|---|
| WO | 96/12615 | 5/1996 |
| WO | 01/31122 | 5/2001 |
| WO | 01/31123 | 5/2001 |
| WO | 01/38638 | 5/2001 |

* cited by examiner

STRONG AND DISPERSIBLE PAPER PRODUCTS

This application is a 371 of PCT/US03/19348, filed Jun. 18, 2003 which claims the benefit of U.S. Provisional Application No. 60/389,778, filed Jun. 19, 2002.

BACKGROUND

The paper industry has for some time needed paper products that are sufficiently strong for their intended application and capable of dispersing quickly and easily. A flushable paper product having both high wet strength and high dispersibility would be useful because such a product would meet the needs of many consumers and markets. For instance, a strong and dispersible bathroom tissue could be easily flushed into septic or sewer systems without clogging the system's pipes.

Currently, we are not aware of any product that offers such benefits. Products made without polymeric strength agents exhibit excellent dispersibility but have poor wet strength. Conversely, paper products made with polymer strength agent have good wet strength but poor to mediocre dispersibility. The advent of "temporary wet strength agents" has improved dispersibility but the available technology is still not sufficiently advanced to meet industry needs and preferences. A truly strong and dispersible flushable product such as bathroom tissue would have great advantages in the marketplace.

U.S. Pat. No. 6,322,665 teaches applying a polymeric anionic reactive compound heterogeneously to a cellulosic fibrous web and curing the compound to crosslink the cellulose fibers. The patent teaches webs that exhibit high wet strength in one direction such as the machine or cross-machine direction, but which readily fail when wet in the orthogonal direction. The patent teaches that flushable products, by virtue of having regions that have not been treated with wet strength agents and specifically with polymeric anionic reactive compounds, have regions that can break apart readily when flushed and sent to a septic system, yet still have wet strength zones to enhance use prior to flushing. Unfortunately, this chemistry contains significant disadvantages. For instance, the polymeric anionic reactive compound must be cured in order to be effective. The polymeric anionic reactive compound produces cellulose-polymer bonds that are less subject to degradation, and thus, more permanent. The patent does not provide guidance about the use of cationic or nonionic strength agents. In fact, the patent expressly discusses the disadvantages of cationic strength agents. Further, the patent does not provide meaningful guidelines about using anionic glyoxylated polyacrylamide polymers, polymers which do not have to be cured. The patent does not provide a comprehensive method that allows the user to control the level of strength and dispersibility of a paper product.

WO 01/38638 A1 teaches the use of an alkaline reagent in wet strength tissue. The document discusses a tissue product comprising a web of fibers, a temporary wet strength agent forming hemi-acetal bonds, and an alkaline reagent. The alkaline reagent is sprayed onto the surface of the sheet in the dry end. The document does not provide meaningful details about how to make a product having both high strength and high dispersibility. The document does not provide guidelines that would enable an artisan to develop a comprehensive method for making paper products with a wide range of different combinations of wet strength and dispersibility.

U.S. Pat. No. 5,952,251 teaches using reinforcing polymer fibers to achieve strength with dispersibility. The patent discusses a paper product having a primary fiber structure which is water dispersible, a secondary fiber structure which delivers strength, and an absorbent material such as pulp fiber. The document does not provide guidelines that would enable an artisan to develop a comprehensive method for making paper products with a wide range of different combinations of wet strength and dispersibility.

The above-mentioned deficiencies are typical in the art.

For the foregoing reasons, there has been an ongoing need to develop a paper product that has both high wet strength and high dispersibility.

For the foregoing reasons, there has been an ongoing need to develop a method for making a paper product having both high wet strength and high dispersibility.

SUMMARY

The invention relates to a paper product comprising a fibrous substrate having (i) at least one strength region comprising a reacted cationic strength agent or a reacted nonionic strength agent and (ii) at least one dispersibility region, wherein the paper product has (a) a dispersibility of at least one tenth of a second, (b) a dry strength, and (c) a wet strength of at least about five percent of the dry strength. These and other features, aspects, and advantages of the present invention will become better understood with reference to the following description and appended claims.

DESCRIPTION

The invention relates to a paper product having a fibrous substrate with at least one strength region that includes a reacted cationic strength agent or a reacted nonionic strength agent and at least one dispersibility region. The invention is based on the discovery that it is possible to make a paper product that is both strong and highly dispersible by selectively modifying a fibrous substrate with a cationic or a nonionic strength agent. By selectively modifying a fibrous substrate, it is now possible to produce a paper product having strength and dispersibility properties that are particularly desirable for its intended use. The invention provides a comprehensive method that allows the user to control the level of strength and dispersibility of a paper product. Advantageously, the method can be adapted in order to provide nearly any level of useful strength or dispersibility desired.

The strength agent used to make the paper products of this invention can be any cationic or nonionic strength agent which, when used in accordance with the invention, produces a paper product having a dispersibility of at least about one tenth of a second and a wet strength that is at least about five percent of the dry strength of the paper product. Suitable cationic and nonionic strength agents, for instance, can include cationic and nonionic glyoxalated polyacrylamides, polymeric amine-epichlorohydrin resins, polyethyleneimines, melamine formaldehydes, and urea formaldehydes, dialdehyde starches, glyoxal, polyvinyl amines, vinyl amine copolymers. Such polymers are known in the art. Useful cationic thermosetting polyamide-epichlorohydrin resins, for instance, include water-soluble polymeric reaction products of epichlorohydrin and polyamides derived from a polyalkylene polyamine and a $C_3$-$C_{10}$ saturated aliphatic dicarboxylic acid, an aromatic dicarboxylic acid, oxalic acid, or urea. In the preparation of these cationic thermosetting resins, the dicarboxylic acid first reacts with the polyalkylene polyamine under conditions that produce a water-soluble polyamide containing the recurring groups:

$$—N(CH_2—CH_2—NH]_n—CORCO]_x,$$

in which n and x are each 2 or more and R is the divalent hydrocarbon radical of the dicarboxylic acid. This water-soluble polyamide then reacts with epichlorohydrin to form the water-soluble cationic thermosetting resin.

Other patents teaching the preparation and/or use of aminopoly-amide-epichlorohydrin resins in wet strength paper applications include U.S. Pat. Nos. 5,239,047, 2,926,154, 3,049,469, 3,058,873, 3,066,066, 3,125,552, 3,186,900, 3,197,427, 3,224,986, 3,224,990, 3,227,615, 3,240,664, 3,813,362, 3,778,339, 3,733,290, 3,227,671, 3,239,491, 3,240,761, 3,248,280, 3,250,664, 3,311,594, 3,329,657, 3,332,834, 3,332,901, 3,352,833, 3,248,280, 3,442,754, 3,459,697, 3,483,077, 3,609,126, and 4,714,736; British patents 1,073,444 and 1,218,394; Finnish patent 36,237 (CA 65: 50543d); French patent 1,522,583 (CA 71: 82835d); German patents 1,906,561 (CA 72: 45235h), 2,938,588 (CA 95: 9046t), 3,323,732 (CA 102: 151160c); Japanese patents 70 27,833 (CA 74: 4182m), 71 08,875 (CA 75: 49990k), 71 12,083 (CA 76: 115106a); 71 12,088 (CA 76: 115107b), 71 36,485 (CA 77: 90336f; Netherlands application 6,410,230 (CA 63: P5858h); South African patent 68 05,823 (CA 71: 114420h); and Swedish patent 210,023 (CA 70: 20755y).

Other suitable cationic strength agents include cationic polyvinyl-amides suitable for reaction with glyoxal, including those produced by copolymerizing a water-soluble vinylamide with a vinyl, water-soluble cationic monomer when dissolved in water, e.g., 2-vinylpyridine, 2-vinyl-N-methylpyridinium chloride, diallyldimethylammonium chloride, (p-vinylphenyl)trimethylammonium chloride, 2-(dimethylamino)ethyl acrylate, methacrylamide propyl trimethyl ammonium chloride, and the like.

Alternatively, glyoxylated cationic polymers may be produced from non-ionic polyvinylamides by converting part of the amide substituents thereof (which are non-ionic) to cationic substituents. One such polymer can be produced by treating polyacrylamide with an alkali metal hypohalite, in which part of the amide substituents are degraded by the Hofmann reaction to cationic amine substituents (see U.S. Pat. No. 2,729,560). Another example is the 90:10 molar ratio acrylamide:p-chloromethylstyrene copolymer which is converted to a cationic state by quaternization of the chloromethyl substituents with trimethylamine. The trimethylamine can be replaced in part or in whole with triethanolamine or other water-soluble tertiary amines. Alternatively still, glyoxylated cationic polymers can be prepared by polymerizing a water-soluble vinyl tertiary amine (e.g., dimethylaminoethyl acrylate or vinylpyridine) with a water-soluble vinyl monomer copolymerizable therewith, e.g., acrylamide, thereby forming a water-soluble cationic polymer. The tertiary amine groups can then be converted into quaternary ammonium groups by reaction with methyl chloride, dimethyl sulfate, benzyl chloride, and the like, in a known manner, and thereby producing an enhancement of the cationic properties of the polymer. Moreover, polyacrylamide can be rendered cationic by reaction with a small amount of glycidyl dimethyl-ammonium chloride.

The copolymers may contain, as the major component thereof, any acrylamide such as acrylamide per se, methacrylamide, or the like. The amount of the acrylamide in the copolymer preferably ranges from about 75 to about 95%, by weight. The cationic comonomer can be any known cationic monomer which is copolymerizable with an acrylamide. Useful comonomers include 2-vinylpyridine, 2-vinyl-N-methylpyridinium chloride, dialkyl(diallyl) dimethyl ammonium chloride, (p-vinylphenyl)trimethyl-ammonium chloride, 2-(dimethylamino)ethyl acrylate, methacrylamido-propyltrimethyl ammonium chloride and the like. It is preferred to employ copolymers containing from about 5 to about 25%, by weight, of the cationic comonomer. Mixtures of these comonomers in concentrations within the above limits may also be used. Up to about 10% by weight, of the acrylamide comonomer of the polymers may be replaced by other comonomers copolymerizable with the acrylamide. Such comonomers include acrylic acid, acrylic esters such as ethyl acrylate, methylmethacrylate, and the like, acrylonitrile, styrene vinylbenzene sulfonic acid and the like. Since the final copolymer is cationic, the only criteria with respect to these comonomers is that they cannot be present in the polymer in amounts greater than cationic comonomer if they are anionic in character. The acrylamide monomer content of the polymers provides the sites to which the glyoxal substituents are attached after glyoxylation. Such cationic polymers are known and are described in U.S. Pat. No. 4,605,702, incorporated herein in its entirety. The temporary wet strength agents disclosed in U.S. Pat. No. 6,365,000, incorporated herein in its entirety, may be used. The permanent wet strength agents listed in U.S. Pat. No. 5,525,664, also incorporated herein in its entirety, can also be used.

The molecular weight of a suitable cationic strength agent or a suitable nonionic strength agent can vary widely depending on the application. As used herein, the term "molecular weight" means weight average molecular weight. Generally, the molecular weight of the cationic strength agent or the nonionic strength agent can be any molecular weight so long as the cationic strength agent imparts the desired wet strength and dispersibility, in accordance with the invention. In one embodiment, the molecular weight of the cationic strength agent or the nonionic strength agent is more than 5000 daltons, or more than about 10,000 daltons. In one embodiment, the molecular weight of the strength agent ranges from about 10,000 to about 100,000 daltons. In another embodiment, molecular weight of the cationic strength agent or the nonionic strength agent is more than 100,000 daltons. In another embodiment, the molecular weight of the strength agent is from about 100,000 to 100,000,000 (one hundred million) daltons, or more. In one embodiment, the molecular weight of the strength agent is from about 100,000 to about 1,000,000 daltons.

The paper product generally has at least one fibrous substrate having a weight ranging from about 5 to about 150 $g/m^2$, or preferably from about 5 to about 85 $g/m^2$. For low weight paper products, the fibrous substrates have a weight ranging from about 15 to about 50 $g/m^2$, preferably from about 5 to about 30 $g/m^2$ and preferably from about 15 to about 30 $g/m^2$. For medium weight paper products, the fibrous substrates have a weight ranging from about 15 to about 150 $g/m^2$, or from about 15 to about 85 $g/m^2$, and more preferably from about 30 to about 60 $g/m^2$. The fibrous substrate in accordance with the invention is generally flushable. As used herein, the term "flushable" means that a paper product is capable of being flushed into a toilet without clogging the toilet, or without clogging approach piping of sewer or septic systems.

The fibrous substrate is generally a paper sheet made from a suitable paper slurry (furnish). The furnish from which the fibrous substrate is made can include any furnish that produces a fibrous substrate suitable for this invention. Furnishes, for instance, can include tissue furnishes, towel furnishes, wet laid furnishes, virgin or recycle furnishes or treated cellulosic furnishes. Depending on the application, the number of fibrous substrates in a paper product can vary. The paper product can have more than one fibrous substrate.

In one embodiment, the paper product has two fibrous substrates, e.g., a two-ply paper product. In another embodiment, the paper product can have more than two fibrous substrates.

The strength regions generally include at least one portion of a fibrous substrate containing a reacted cationic strength agent or a reacted nonionic strength agent. The reacted cationic strength agent or the reacted nonionic strength agent essentially functions as a strength-imparting polymeric network. As such, the strength regions provide wet tensile strength to the sheet while in use. However, when in water, the dispersibility regions of the fibrous substrate quickly disperse, thereby allowing the paper product to exhibit excellent flushability.

The strength regions can be located at any portion of a paper product, as long as the strength regions provide sufficient wet strength for the paper products intended use without sacrificing the paper product's dispersibility. In one embodiment, for instance, strength regions extend throughout at least one surface of a fibrous substrate. In another embodiment, the strength regions extend over both surfaces of a fibrous substrate. In another embodiment, the strength regions are within the fibrous substrate. In another embodiment, the strength regions are located both on the surface and within the fibrous substrate.

The strength regions generally extend over at least one surface of a fibrous substrate in any pattern that imparts desirable strength characteristics without compromising the dispersibility of the paper product. For instance, in one embodiment, the strength regions form a "grid-like" pattern on the surface of a fibrous substrate and a plurality of parallel and perpendicular linear regions. In another embodiment, the strength regions are represented by a circular pattern. In another embodiment, the strength regions are represented by a wavy-line pattern. In one embodiment, the strength regions form an interlocking serpentine pattern. The line thickness of the pattern can be any thickness that enables the strength agent to impart the desired wet strength. In one embodiment, the strength regions are preferably connected with one another or overlap with one another, such that the combination of connected or overlapping strength regions form a continuous polymeric network extending from one edge of a fibrous substrate to the opposite end of the fibrous substrate. In an embodiment in which the paper product has more than one fibrous substrate, e.g., a two ply paper product, the strength regions can be located between the fibrous substrates.

The area of each strength region can vary considerably, depending on the application. Generally, the area of a strength region various from about 0.01% to about 75% of the total area of a surface of a fibrous substrate. The total area encompassed by the strength regions over a surface of a fibrous substrate is generally less than about 90%, or less than about 75%, or less than about 60% the total area of the surface. In one embodiment, the strength regions generally encompass less than about 50% of the area of a surface of the fibrous substrate. In another embodiment, the strength regions encompass less than about 25% of the area of a surface of the fibrous substrate. In another embodiment, the strength regions encompass less than about 10% of the area of a surface of the fibrous substrate.

The dispersibility regions generally include portions of the fibrous substrate which have relatively less wet and dry strength than the strength regions of the paper product. The dispersibility regions essentially function as dispersibility-imparting members and can be located at any portion of a paper product, provided that the dispersibility regions provide sufficient dispersibility to a paper product's intended use without sacrificing the paper product's wet strength. In one embodiment, for instance, the dispersibility regions extend throughout at least one surface of a fibrous substrate. For instance, when the strength regions encompass a grid pattern extending over at least one surface of the fibrous substrate, the dispersibility regions are the regions between the grid pattern, e.g., the rectangularly shaped regions formed by the plurality of parallel and perpendicular linear regions. In another embodiment, the dispersibility regions extend over both surfaces of a fibrous substrate. In another embodiment, the dispersibility regions are within the fibrous substrate. In another embodiment, the dispersibility regions are located both on the surface and within the fibrous substrate.

In one embodiment, the dispersibility regions are devoid entirely or substantially devoid of a reacted cationic strength agent or a reacted nonionic strength agent. In another embodiment, the dispersibility regions contain some reacted cationic strength agent or reacted nonionic strength, provided however, that strength agent in the dispersibility regions is present in an amount that is less than the amount of the reacted strength agent in the strength regions. The amount of strength agent in the dispersibility regions will vary, depending on the application and, of course, the amount of reacted cationic strength agent or reacted nonionic strength agent in the strength regions. As a general guideline, however, strength regions will have at least 10 or 20 weight % more reacted cationic strength agent or reacted nonionic strength agent that the dispersibility regions. In one embodiment, the weight ratio of the strength agent in the strength regions to the dispersibility regions, per unit area, e.g., $cm^2$, is from about 1.1 or 1.2:1 to about 500:1. In other embodiments, the weight ratio of the strength agent in the strength regions to the dispersibility regions, per unit area, is from about 1.1:1 to about 400:1, or from about 1.1:1 to about 300:1, or from about 1.1:1 to about 200:1, or from about 1.1:1 to about 100:1. Still, in other embodiment, the weight ratio of the strength agent in the strength regions to the dispersibility regions, per unit area, is from about 1.2:1 to about 20:1, from about 5:1 to about 15:1, or from about 5:1 to about 10:1.

The wet strength imparted by the strength regions is sufficient to enable the paper product to be used in its intended application without physically deteriorating. Generally, the wet strength of the paper product is at least about 5% of the dry strength of the paper product. In another embodiment, the wet strength of the paper product is at least about 10% of the dry strength of the paper product, or at least about 25% of the dry strength of the paper product. In one embodiment, the wet strength of the paper ranges from about 5% to about 50% of the dry strength of the paper product. In another embodiment, the wet strength of the paper ranges from about 5% to about 35% of the dry strength of the paper product. In another embodiment, the wet strength of the paper ranges from about 5% to about 25% of the dry strength of the paper product.

The desired wet strength of paper products will depend on the type of paper product and its intended use. For instance, for a tissue paper product, the wet strength can range from about 0.005 lb./in. (0.89 g/cm) to about 0.5 lb./in. (89.3 g/cm), preferably from about 0.1 lb./in (17.86 g/cm) to about 0.5 lb./in (89.3 g/cm). For a towel paper product, the wet strength can range from about 0.1 lb./in. (17.86 g/cm) to about 1 lb./in. (178.58 g/cm), preferably from about 0.5 lb./in. (89.3 g/cm) to about 1 lb./in 178.58 g/cm). For 35 lb. 50/50 hardwood/softwood sheets, the wet strength can range from about 0.1 lb./in. (17.86 g/cm) to about 5 lb./in. (892.3 g/cm), preferably from about 0.3 lb./in. (53.74) to about 5 lb./in. (892.3 g/cm).

The dry strength of a paper product of the invention can vary. For instance, for tissue paper products, the dry strength can range from about 0.1 lb./in. (17.86 g/cm) to about 10 lb./in. (1785.8 g/cm), preferably from about 2 lb./in (357.16 g/cm) to about 10 lb./in (1785.8 g/cm). For towel paper products, the dry strength can range from about 2 lb./in. (357.16 g/cm) to about 20 lb./in. (3,571.6 g/cm), preferably from about 10 lb./in. (1785.8 g/cm) to about 20 lb./in. (3571.6 g/cm) For 35 lb. 50/50 hardwood/softwood sheets, the dry strength can range from about 2 lb./in. (357.16 g/cm) to about 100 lb./in. (17,858 g/cm), preferably from about 20 lb./in. (3,571 g/cm) to about 100 lb./in. (17,858 g/cm).

The wet strength of a paper product is determined as follows. To determine the wet strength of a paper product, a strip of a paper sheet having a width of about 1" (2.54 cm) and a length of about 4.5" (11.4 cm) is placed in the jaws of a Thwing-Albert tensile tester, or a functionally equivalent device. The paper is sprayed with water and then the sample is immediately pulled apart in the direction of its length. The "wet strength," as the term is used herein, is the load required to pull the sample apart and is expressed in lb/in or g/cm.

The combination of the strength and dispersibility regions produces a paper product that has sufficient dispersibility for its intended use. Generally, the dispersibility of the paper product will be at least about one tenth of a second. In one embodiment, the dispersibility of the paper product ranges from about one tenth of one second to about 30 minutes, or more. In another embodiment, the dispersibility ranges from about one tenth of one second to about 20 minutes. In another embodiment, the dispersibility ranges from about one tenth of one second to about 10 minutes. In another embodiment, the dispersibility ranges from about one tenth of one second to about five minutes. In another embodiment, the dispersibility ranges from about one tenth of one second to about 4 minutes. In another embodiment, the dispersibility ranges from about one tenth of one second to about 3 minutes. In another embodiment, the dispersibility ranges from about one tenth of one second to about 2 minutes. In another embodiment, the dispersibility ranges from about one tenth of one second to about 1 minute.

As the above-mentioned ranges suggest, our invention is extremely versatile such that the dispersibility of a paper product in accordance with the invention can advantageously be controlled in accordance to the anticipated use of a specific type of paper product. For instance, for a tissue paper product (e.g., a low-weight sheet including sanitary products such as bathroom and facial tissues, paper napkins, and industrial tissues such as wrapping, condenser, and carbonizing grades), the dispersibility of a tissue paper product can range from about one tenth of one second to about 10 minutes, preferably from about five seconds to about two minutes. For a towel paper product, e.g. (a medium weight sheet generally used for home and industrial cleaning applications), the dispersibility may range from about five seconds to about ten minutes, preferably from about ten seconds to about two minutes. In one embodiment, the dispersibility of the towel paper product can range from about 20 seconds to about two minutes. In another embodiment, the dispersibility of a towel paper product can be greater than five hours. For 35 lb. 50/50 hardwood/softwood sheets, the dispersibility for such sheets can range from about five seconds to about 30 minutes, preferably from about 10 seconds to about two minutes. The artisan will appreciate that depending on the type of paper slurry (furnish) used, the strength and dispersibility of paper products will vary.

The "dispersibility" of a paper product, as the term "dispersibility" is used herein, is determined by placing a paper product in a 1000 ml beaker with 500 ml tap water and agitating the product at 300 rpm with an over-head stirrer at room temperature (25° C.). The paper product can have a surface area of approximately 11 $cm^2$. The dispersibility of a paper product is the time that it takes for portions of the fibrous substrate to detach from the paper product. As such, as used herein, if the "dispersibility" of a paper product is said to be at least about five seconds, this means that it takes about five seconds, or longer, for a portion of the paper product to break away from the paper product after being agitated under the above-mentioned conditions.

The strength regions and the dispersibility regions can be physically or chemically modified to enable the user to make a paper product having a wide range of combinations of wet strength and dispersibility properties. For instance, in one embodiment, the dispersibility regions have perforations, which may or may not be filled with a reacted cationic strength agent or a reacted nonionic strength agent. In this embodiment, when the perforations are filled with a strength agent, the filled perforations function as additional strength regions and enhance dispersibility of the paper product. In another embodiment, the strength or dispersibility regions have a reacted strength reducing material, such as an enzyme, that reduces the strength of the strength or dispersibility regions. When such a strength reducing material is used, it is preferred that the material be used in conjunction with a cationic strength agent. In one embodiment, the strength and dispersibility regions can be modified with a sizing agent. As such, by use of strength regions and dispersibility regions having different physical and chemical properties, the paper product in accordance to the invention has enough strength agent to enable the product to maintain its useful physical features without sacrificing the paper's desired dispersibility.

In one embodiment, a cationic strength agent or a nonionic strength agent is distributed throughout the fibrous substrate and at least one region of a strength reducing material, e.g., an alkaline material such as sodium bicarbonate or an enzyme, extends over at least one surface of the fibrous substrate. In this embodiment, the reacted strength reducing material forms the dispersibility regions and the regions between the reacted strength reducing material are the strength regions.

As such, the invention provides a wide variety of products having desirable wet strength and dispersibility properties. In one embodiment, our invention provides a flushable paper product comprising a fibrous substrate having (i) a plurality of strength regions comprising a reacted cationic or a reacted nonionic strength agent and (ii) a plurality of dispersibility regions, such that the paper product has (a) a dispersibility of at least one tenth of a second, (b) a dry strength, and (c) a wet strength of at least about five percent the dry strength of the paper product. In another embodiment, the invention provides a paper product comprising (a) a fibrous substrate having a first surface and a second surface, (b) at least one strength region comprising a reacted cationic strength agent or a reacted nonionic strength agent, (c) at least one dispersibility region comprising a reacted cationic strength agent or a reacted nonionic strength agent in an amount that is relatively less than the reacted cationic strength agent or the reacted nonionic strength agent present in the strength regions. In another embodiment, our invention provides a paper product comprising (a) a fibrous substrate having a first surface and a second surface, (b) a plurality of strength regions extending throughout the fibrous substrate, and (c) at least one reacted strength reducing agent extending over the first surface or the second surface of the fibrous substrate.

In a preferred embodiment, the invention provides a tissue paper product comprising (a) a tissue paper fibrous substrate having a first surface and a second surface and a weight ranging from about 5 to about 50 $g/m^2$, in which the first surface and second surface have a width ranging from about 8 to about 12 cm, (b) a plurality of strength regions distributed over at least one surface, and (c) a plurality of dispersibility regions located between the strength regions. In another embodiment, the invention provides a towel paper product having a weight ranging from about 15 to about 50 g/m$^2$ and comprising (a) at least one tower paper fibrous substrate having a first surface and a second surface, wherein the first and second surface have a width ranging from about 25 to about 35 cm, preferably from about 32 to about 26 cm, (b) a plurality of strength regions extending over at least one surface of the paper product, and (c) a plurality of dispersibility regions located between the strength regions.

The process for making a paper product in accordance with the invention generally involves applying a cationic or a nonionic strength agent to a fibrous substrate and forming at least one strength region and at least one dispersibility region, such that the strength region(s) and the dispersibility region(s) is or are sufficient to produce a paper product having a dispersibility that is at least one tenth of a second and a wet strength that is at least about five percent of the dry strength of the paper product. Advantageously, the strength agent does not have to be cured.

In one embodiment, the strength agent is applied in a pattern between two or more fibrous substrates (plies), and thereby the method provides both ply adhesion as well as excellent dispersibility. In another embodiment, the strength agent is applied over perforations in the dispersibility regions, thereby enhancing dispersibility. In another embodiment, the strength regions can be formed by treating a fibrous substrate with a strength agent in an amount ranging from about 18 (0.9 wt %) to about 250 lb./ton (12.5 wt %), preferably from about 20 (1 wt %) to about 100 lb./ton. (5 wt %). The dispersibility regions can be treated with a strength agent in an amount ranging from 0 to about 15 lb./ton (0.75 weight %), preferably from 0 to about 5 lb./ton (0.25 wt %).

In one embodiment, the fibrous substrate is thoroughly treated with a cationic strength agent or a nonionic strength agent. In this embodiment, the strength reducing material, e.g., sodium bicarbonate or an enzyme, is then applied over the fibrous substrate such that the reacted strength reducing material forms the dispersibility regions and the regions between the reacted strength reducing material are the strength regions. When exposed to water, the substrate rapidly breaks down along the regions formed by the reacted strength reducing material. In another embodiment, the strength agent is applied in a pattern in such a way that the strength agent is essentially used as a creping aid—a material that is generally sprayed onto a Yankee dryer to provide good conditions for preparing high bulk soft tissue. A creping agent is often applied to the Yankee dryer to aid in the wet deforming process used to increase the stretchability of tissue paper. In this embodiment, the strength agent serves the dual purposes of creping agent and strength agent.

The equipment used to apply the strength agent can be any equipment that enables the strength agent to selectively form strength regions such that the paper product has a dispersibility that is at least about one tenth of a second and a wet strength that is at least about five percent the dry strength of the paper product. In one embodiment, the strength agent can be applied with equipment that is now currently used in ink-jet applications. In another embodiment, the strength agent can be applied with a hydraulic nozzle. In another embodiment, the strength agent can be applied with roll-coaters. In another embodiment, the strength agent can be applied using a pump driven nozzle array. In another embodiment, the strength agent can be applied using a non-contact metering unit.

Our invention provides valuable benefits to the industry. Given that the invention provides a comprehensive system for controlling the strength and dispersibility properties of a paper product, it is now possible to make paper products having different desired, predetermined strength and dispersibility properties. One embodiment of our invention provides paper products with desired softness, because the entire area of a fibrous substrate is not treated with a strength agent.

Although the invention has been directed to embodiments in which the strength regions are reacted cationic or reacted nonionic strength agents, in one embodiment it is possible to use an anionic glyoxylated acrylamide such that the strength regions are a reacted glyoxylated acrylamide. In this embodiment, the anionic glyoxylated acrylamide can be used in conjunction with the cationic or nonionic strength agent. These polymers can be made by polymerizing acrylamide monomers and comonomers such as acrylic acid, acrylic esters such as ethyl acrylate, methylmethacrylate, and the like, acrylonitrile, styrene vinylbenzene sulfonic acid, and the like. As such, the foregoing description of the paper products made with nonionic strength agents and cationic strength agents is also applicable for embodiments in which an anionic glyoxylated polyacrylamide is used.

Although the present invention has been described in detail with reference to certain preferred versions thereof, other variations are possible. Therefore, the spirit and scope of the appended claims should not be limited to the description of the versions contained therein.

What is claimed is:

1. A bathroom tissue or facial tissue comprising a fibrous substrate made from a wet laid furnish, the bathroom tissue or facial tissue having (i) at least one strength region comprising from about 0.9% to about 5% by weight, based on the weight of the fibrous substrate, of a reacted cationic or a reacted nonionic strength agent and (ii) at least one dispersibility region, wherein the bathroom tissue or facial tissue has (a) a dispersibility of at least one tenth of a second, (b) a dry strength, and (c) a wet strength of at least about five percent of the dry strength of the bathroom tissue or facial tissue; wherein the reacted cationic strength agent or the reacted nonionic strength agent is selected from the group consisting of cationic glyoxalated polyacrylamides, nonionic glyoxalated polyacrylamides, polymeric amine-epichlorohydrin resins, polyethyleneimines, melamine formaldehydes, urea formaldehydes, dialdehyde starches, glyoxal, and mixtures thereof; wherein the strength region does not comprise polyvinyl amines or vinyl amine copolymers; and wherein the strength regions have a reacted cationic strength agent or a reacted nonionic strength agent in an amount of at least 10 weight % per unit area greater than the reacted cationic strength agent or the reacted nonionic strength agent present in the dispersibility regions.

2. The bathroom tissue or facial tissue of claim 1, wherein the strength regions comprise a grid-shaped pattern of parallel and perpendicular linear regions on the surface of the fibrous substrate.

3. The bathroom tissue or facial tissue of claim 1, wherein the strength regions are located adjacent to a first surface of the fibrous substrate.

4. The bathroom tissue or facial tissue of claim 3, wherein the fibrous substrate further comprises strength regions on a second surface of the fibrous substrate.

5. The bathroom tissue or facial tissue of claim 1, wherein the dispersibility regions contain perforations.

6. The bathroom tissue or facial tissue of claim 5 wherein the perforations are filled with a reacted cationic strength agent or a reacted nonionic strength agent.

7. The bathroom tissue or facial tissue of claim 1, wherein the bathroom tissue or facial tissue has a wet strength that is at least about ten percent of the dry strength of the bathroom tissue or facial tissue.

8. The bathroom tissue or facial tissue of claim 1, wherein the bathroom tissue or facial tissue has a dispersibility that is at least about one second.

9. The bathroom tissue or facial tissue of claim 1, wherein the strength regions are located on a first surface of the fibrous substrate.

10. The bathroom tissue or facial tissue of claim 9, wherein the strength regions are further located on a second surface of the fibrous substrate.

11. The bathroom tissue or facial tissue of claim 1, wherein the bathroom tissue or facial tissue further comprises a reacted strength reducing material.

12. The bathroom tissue or facial tissue of claim 1, wherein the strength regions comprise an interlocking serpentine pattern.

13. A bathroom tissue or facial tissue comprising:

(a) a fibrous substrate made from a wet laid furnish, the fibrous substrate having a first surface and a second surface and having a weight ranging from about 15 to about 150 g/m$^2$;

(b) at least one strength region comprising from about 0.9% to about 5% by weight, based on the weight of the fibrous substrate, of a reacted cationic strength agent or a reacted nonionic strength agent; wherein the reacted cationic strength agent or the reacted nonionic strength agent is selected from the group consisting of cationic glyoxalated polyacrylamides, nonionic glyoxalated polyacrylamides, polymeric amine-epichlorohydrin resins, polyethyleneimines, melamine formaldehydes, urea formaldehydes, dialdehyde starches, glyoxal, and mixtures thereof; wherein the strength region does not comprise polyvinyl amines or vinyl amine copolymers; and (c) at least one strength region comprising a reacted cationic strength agent or a reacted nonionic strength agent in an amount of at least 10 weight % per unit area greater than the reacted cationic strength agent or the reacted nonionic strength agent present in the at least one dispersibility region.

14. A method for making a bathroom tissue or facial tissue comprising selectively applying from about 0.9% to about 5% by weight of a strength agent to a fibrous substrate made from a wet laid furnish, and forming at least one strength region and at least one dispersibility region; wherein the at least one strength region and the at least one dispersibility region are sufficient to produce a bathroom tissue or facial tissue having a dispersibility that is at least one tenth of a second and a wet strength that is at least about five percent of the dry strength of the bathroom tissue or facial tissue; wherein the strength agent is selected from the group consisting of cationic glyoxalated polyacrylamides, nonionic glyoxalated polyacrylamides, polymeric amine-epichlorohydrin resins, polyethyleneimines, melamine formaldehydes, urea formaldehydes, dialdehyde starches, glyoxal, and mixtures thereof; wherein the strength region does not comprise polyvinyl amines or vinyl amine copolymers; and wherein the strength regions have a reacted cationic strength agent or a reacted nonionic strength agent in an amount of at least 10 weight % per unit area greater than the reacted cationic strength agent or the reacted nonionic strength agent present in the strength dispersibility regions.

* * * * *